US012767897B2

(12) United States Patent
Murugesan et al.

(10) Patent No.: US 12,767,897 B2
(45) Date of Patent: Oct. 20, 2026

(54) SULFUR EXTRACTION FROM HYDROCARBONS USING CARBONATE-BASED SOLVENTS

(71) Applicant: Baker Hughes Oilfield Operations LLC, Houston, TX (US)

(72) Inventors: Sankaran Murugesan, Katy, TX (US); Jerry J. Weers, Richmond, TX (US); Sai Reddy Pinappu, Sugar Land, TX (US); Onome Ugono, Rosenberg, TX (US); Kekeli A. Ekoue-Kovi, Rosenberg, TX (US)

(73) Assignee: Baker Hughes Oilfield Operation LLC, Houston, TX (US)

( * ) Notice: Subject to any disclaimer, the term of this patent is extended or adjusted under 35 U.S.C. 154(b) by 0 days.

(21) Appl. No.: 17/960,592

(22) Filed: Oct. 5, 2022

(65) Prior Publication Data

US 2024/0132787 A1 Apr. 25, 2024

(51) Int. Cl.
*C10G 21/02* (2006.01)

(52) U.S. Cl.
CPC ..... *C10G 21/02* (2013.01); *C10G 2300/202* (2013.01); *C10G 2300/207* (2013.01)

(58) Field of Classification Search
CPC ..... C10G 21/02; C10G 2300/202
See application file for complete search history.

(56) References Cited

U.S. PATENT DOCUMENTS 4,097,250 A * 6/1978 Pagani ..... C07C 7/04 62/929
6,358,402 B1 3/2002 Schucker
6,413,488 B1 * 7/2002 Smith ..... C01B 17/0205 423/576.2
8,298,320 B2 10/2012 Cozean
8,807,214 B2 8/2014 Khan et al.
9,463,989 B2 10/2016 Menendez et al.
9,856,423 B2 1/2018 Hao et al.
9,914,885 B2 3/2018 Choi et al.
10,093,868 B1 * 10/2018 Weers ..... B01J 20/22
(Continued)

FOREIGN PATENT DOCUMENTS

CN 103920380 A * 7/2014
CN 106833719 A 6/2017
(Continued)

OTHER PUBLICATIONS

Machine Translation of CN-103920380-A (Year: 2014).*
(Continued)

*Primary Examiner* — Ellen M Mcavoy
*Assistant Examiner* — Ming Cheung Po
(74) *Attorney, Agent, or Firm* — Crowe & Dunlevy, P.C.

(57) ABSTRACT

Non-acidic sulfur compounds (e.g., thiols) can be selectively extracted from a hydrocarbon stream containing them (e.g., crude oil) by contacting the hydrocarbon stream with a carbonate solvent that contains at least one organic carbonate (e.g., propylene carbonate) in an amount effective to selectively absorb and extract the non-acidic sulfur compounds therefrom. The carbonate solvent may optionally also comprise an additional solvent (e.g., caprolactam), a soluble metal salt (e.g., a metal salt where the metal is iron), and/or a mercaptan scavenger that is a heterocyclic amine (e.g., oxazolidine).

20 Claims, 3 Drawing Sheets

(56) References Cited

U.S. PATENT DOCUMENTS

| | | | | |
|---|---|---|---|---|
| 10,414,989 | B2 | 9/2019 | Weers et al. | |
| 10,570,344 | B2 | 2/2020 | Weers et al. | |
| 10,604,539 | B2 | 3/2020 | Boday et al. | |
| 10,633,601 | B2 | 4/2020 | Weers | |
| 10,822,549 | B2 | 11/2020 | Biggerstaff et al. | |
| 11,053,447 | B2 | 7/2021 | Weers et al. | |
| 2009/0107890 | A1* | 4/2009 | Hamad | C10G 21/20 208/208 R |
| 2011/0000823 | A1 | 1/2011 | Hamad et al. | |
| 2014/0262740 | A1 | 9/2014 | Mccaulley | |
| 2017/0335204 | A1* | 11/2017 | Ekoue-Kovi | C10G 29/20 |
| 2019/0144761 | A1* | 5/2019 | Weers | C07C 7/20 208/240 |

FOREIGN PATENT DOCUMENTS

| | | | | |
|---|---|---|---|---|
| CN | 108003934 | A | 5/2018 | |
| WO | 0159033 | A1 | 8/2001 | |
| WO | WO-2007103440 | A2 * | 9/2007 | C10G 17/02 |

OTHER PUBLICATIONS

"International Search Report and Written Opinion for PCT/US2023/034577 mailed Feb. 2, 2024".

Javadli, Rashad et al., "Desulfurization of heavy oil", Appl. Petrochem Res., Mar. 2012, 17 pp.

Kobotaeva, Natalia et al., "Extractants Based on Coordinating Liquid Polar Solvents for Removal of Sulfur Compounds from Diesel Fuels", Appl. Sci, Jun. 2018, 8pp.

* cited by examiner

SULFUR EXTRACTION FROM HYDROCARBONS USING CARBONATE-BASED SOLVENTS

TECHNICAL FIELD

The present invention relates to the removal of non-acidic sulfur compounds from hydrocarbon streams containing them, and more particularly relates, in one non-limiting embodiment, to methods for selectively extracting non-acidic sulfur compounds from hydrocarbon streams containing them by contacting the stream with a carbonate solvent.

TECHNICAL BACKGROUND

The removal of hydrogen sulfide and other sulfur species from hydrocarbon fluids in oil and gas production and refining is important because of the many safety and environmental hazards posed by the presence of such species.

For example, during combustion, sulfur-rich hydrocarbon streams produce heavy environmental pollution. Further, when sulfur-rich streams contact metals, sulfur species lead to brittleness in carbon steels and to stress corrosion cracking in more highly alloyed metals used in oil and gas production and refining operations.

Desulfurization is a process used for the effective removal of sulfur from the heavy crude oil and processed heavy oils such as gas oil, slurry oil and fuel oil. The desulfurization methods include, but are not necessarily limited to, hydrodesulfurization, extractive desulfurization, oxidative desulfurization, biodesulfurization and desulfurization through alkylation, chlorinolysis, and by using supercritical water. Hydrogen sulfide ($H_2S$) is considered acidic, and mercaptans are mildly acidic. The different class of non-acidic sulfur compounds present in heavy fuels are thiols, sulfides, thiophene and dibenzothiophene. Important classes of non-acidic sulfur-containing compounds in crude oil (R=alkyl) are given below.

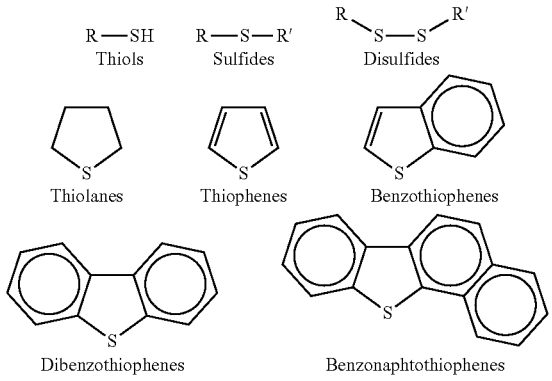

Fuel specifications that govern transportation fuels have over the years become increasingly stringent with respect to sulfur content. For example, recently IMO 2020 restricts use of marine fuels to those that have sulfur contents from 3.5% down to 0.5%. The removal of sulfur from oil is consequently one of the central conversion requirements in most refineries and the price (and processing cost) of a crude oil is influenced by its sulfur content. The chemical nature of the sulfur has direct bearing on its removal. Desulfurization of compounds that contain aliphatic sulfur, i.e., thiols and sulfides, is easier than desulfurization of compounds that contain aromatic sulfur, i.e., thiophenics. Most of the available methods have limitations to their application due to requirements of high infrastructure cost and poor removal efficiency.

Refiners desire to limit their capital expenditures and seek alternatives to the building of additional hydrotreating capacity, so they are seeking alternatives to remove these sulfur compounds from their distillates.

It would be desirable to remove sulfur compounds from refinery distillate streams and other hydrocarbon streams and volumes using an alternative process to those presently in use.

SUMMARY

There is provided in one non-limiting embodiment a method for selectively extracting non-acidic sulfur compounds from a hydrocarbon stream containing the non-acidic sulfur compounds, where the method includes contacting the hydrocarbon stream with a carbonate solvent, where the carbonate solvent comprises at least one organic carbonate and in an amount of carbonate solvent that is effective to selectively extract at least a portion of the non-acidic sulfur compounds from the hydrocarbon; and thereby selectively absorbing and extracting at least a portion of the non-acidic sulfur compounds from the hydrocarbon stream into the carbonate solvent.

In an alternative non-restrictive version, there is provided a treated stream that includes hydrocarbons; at least one non-acidic sulfur compound; and a carbonate solvent having at least one organic carbonate, where the at least one organic carbonate is present in an amount effective to selectively extract at least a portion of the non-acidic sulfur compound from the treated stream into the carbonate solvent.

DETAILED DESCRIPTION

Figure 1:
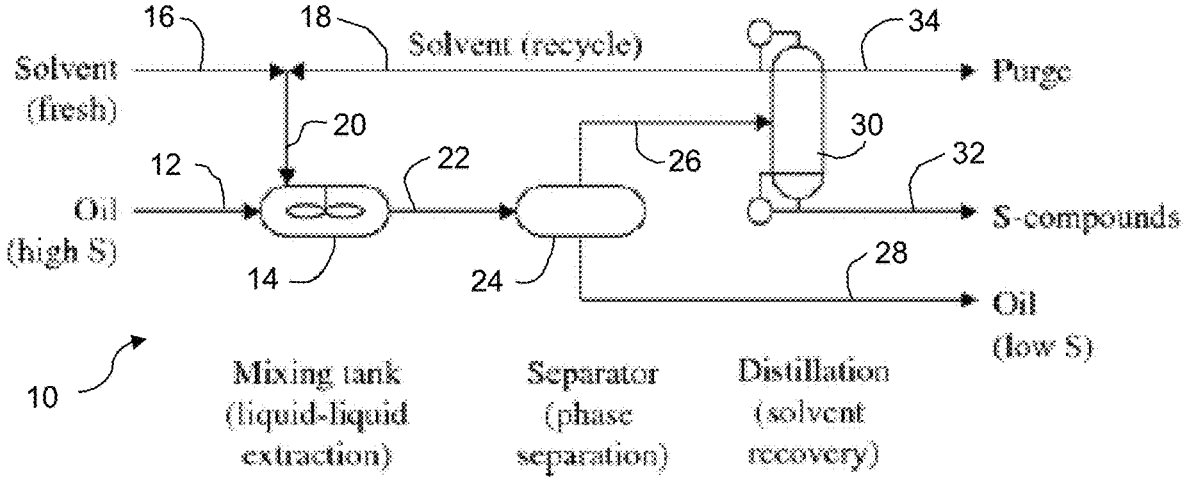
FIG. 1 is a non-limiting, schematic illustration of one system for recycling and reusing the carbonate solvent used in the present method.

It has been discovered that treatment of certain volumes and streams generally containing hydrocarbons, particularly crude oils, but also other hydrocarbon types, with a carbonate solvent comprising at least one organic carbonate, results in the reduction of non-acidic sulfur compounds that are present by selective extraction.

In a non-limiting embodiment, the carbonate solvent having at least one organic carbonate is injected or introduced into a stream or volume of a hydrocarbon containing non-acidic sulfur compounds. Typically, the extraction solvent is added to a hydrocarbon stream, such as a crude oil, in a line ahead of a pump and/or a mix valve which provides the needed mixing. The organic carbonate does not chemically react with the non-acidic sulfur compounds but selectively solvates and removes them. While it is appreciated that the organic carbonate may also remove acidic sulfur compounds (e.g., hydrogen sulfide ($H_2S$) and mercaptans), it is considered more likely that these acidic sulfur compounds react with the organic carbonates as contrasted with the non-acidic sulfur compounds which do not react with the organic carbonates.

It is further understood in one non-limiting explanation, that the organic carbonate in the present method after having absorbed the non-acidic sulfur compounds, is separated out by taking advantage using immiscibility and gravity. The organic carbonate acts as a solvent, and the solvation energy provided by the carbonate helps the non-acidic sulfur compounds to be dissolved and/or absorbed in the carbonate solvent. A further difference is that since the organic carbonates have a higher density compared to the hydrocarbon stream, separation via gravity or other technique, such as centrifugation, is facilitated.

The at least one organic carbonate includes, but is not necessarily limited to, ethylene carbonate, propylene carbonate, glycerol carbonate, styrene carbonate, and combinations thereof. For instance, organic cyclic alkyl carbonates ethylene carbonate and propylene carbonate, have the respective structures:

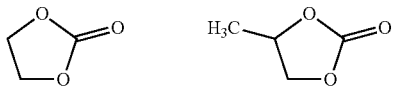

These alkyl carbonates may also be called carbonate esters. Removing compounds that contain aliphatic sulfur, e.g., thiols and sulfides, is easier than removing compounds that contain aromatic sulfur, e.g., thiophenics. The organic carbonates added to the hydrocarbon stream being treated are in liquid form under the expected treatment conditions.

Suitable non-acidic sulfur compound-containing refinery distillate streams include, but are not necessarily limited to, crude oil, heavy fuel oil, middle distillates, diesel fuel, gas oil, slurry oil, lighter hydrocarbons, and mixtures thereof. As defined herein, "lighter hydrocarbons" are C1 (methane) to C5 (pentanes).

The selectivity of these scavengers for non-acidic sulfur compounds in the presence of other sulfur-containing compounds, such as acidic sulfur compounds, e.g., hydrogen sulfide ($H_2S$) and mercaptans is an advantage It is expected that the alkyl carbonates described herein will be soluble and/or dispersible in most of the systems described and will not form solids. Further, the methods described herein are expected to also be effective in oilfield applications, including, but not necessarily limited to, removing non-acidic sulfur compounds from oilfield condensates, natural gas, and the like. The methods described herein may also be effective in treating natural gas liquids (NGL) or liquid petroleum gas (LPG) within or as it is withdrawn from a storage facility.

The effective amount of organic carbonate added is any amount that is effective to absorb at least a portion of the non-acidic sulfur compounds. The organic carbonate having the absorbed non-acidic sulfur compounds may still be within the hydrocarbon, but the hydrocarbon, e.g., crude oil is free of non-acidic sulfur compounds, or at least has a reduced amount thereof.

In a more specific, non-limiting embodiment, an effective amount of carbonate solvent to the hydrocarbon stream ranges from a volume ratio of about 1 to 99 to about 50 to 50. Other suitable endpoint alternatively ratios include 60 to 40, 70 to 30, and 80 to 20. For example, a suitable alternative volume ratio of carbonate solvent to hydrocarbon may be from about 60 to 40 to about 80 to 20, or alternatively from about 10 to 90 to about 70 to 30.

It is expected that in most cases, the organic carbonate solvent will be contacted with the hydrocarbon stream and it will be the solution which extracts the non-acidic sulfur compounds away from the hydrocarbon, that is, in a single step. With respect to dose rates, if the alkyl carbonate solution may be simply injected into a hydrocarbon stream or volume, a ratio of volume of organic carbonate to volume of hydrocarbon ratio based on the chemistry may be provided as noted above. However, if the hydrocarbon is bubbled through a solution of the organic carbonate, then the amount of organic carbonate solvent will be relatively large in a tower as compared with the relatively small amount of hydrocarbon and/or organic carbonate migrating through the carbonate solvent.

For gas treating applications, such as in tower applications, where hydrocarbon containing non-acidic sulfur compounds is bubbled through the organic carbonate solution, the ratio will be higher as there are only small bubbles of the hydrocarbon migrating up through the organic carbonate solvent in the tower. There will be a relatively large volume of the organic carbonate solvent present since it fills the contact tower and only a relatively small amount of non-acidic sulfur compounds are present in the small bubbles of the hydrocarbon migrating their way through the organic carbonate solution. In this latter case, the ratio of organic carbonate to hydrocarbon can range from about 95 vol % organic carbonate solvent independently to as low as 1 vol % alkyl carbonate to hydrocarbon stream (in a non-limiting example); alternatively, on the order of about 10 independently to about 50 vol % organic carbonate solvent to hydrocarbon stream. Further, the word "independently" as used herein with respect to a range herein means that any lower threshold may be used with any upper threshold to provide a suitable alternative range.

Generally, the organic carbonate can be present at a level in the treated hydrocarbon stream such that the concentration of non-acidic sulfur compounds in the stream is lowered to from about 1 or less than 1 independently to about 5 ppm. In other embodiments the concentration after treatment is from about 0.1 independently to about 100 ppm. In one non-limiting embodiment, there may remain from about 1 to about 2 ppm non-acidic sulfur compounds in the treated hydrocarbon and specifications may still be met. In one non-limiting embodiment the highest levels of non-acidic sulfur compounds expected to be treated in the hydrocarbon stream will be on the order of 500 ppm and it may be desired to reduce non-acidic sulfur compounds content to less than 1 ppm. Alternatively, an expected starting non-acidic sulfur compounds content of 100 ppm or less which can be reduced to 3 ppm or less, and in a different non-restrictive version the starting sulfur content may be about 50 or less, which can be reduced to 5 ppm or less.

The temperature range for the contacting by the organic carbonate will only be limited by the additive properties. The hydrocarbon stream being treated cannot be so hot that lighter components are flashed off and only solid organic carbonate is left behind. The organic carbonate should be in soluble, liquid form. Conversely, the stream cannot be so cold that the carbonate solvent freezes and does not mix with the hydrocarbon stream. In general, it is expected that relatively hotter will be better than relatively colder since kinetics improve as temperature increases, but again in general, the temperature cannot be so hot that the lighter components all flash off.

The method for selectively extracting non-acidic sulfur compounds from a hydrocarbon stream can be practiced in a number of different embodiments. In a first non-limiting embodiment, the carbonate solvent only consists of or consists essentially of organic carbonate. Any other components present do not affect the ability of the carbonate solvent to absorb the non-acidic sulfur compounds.

In a second non-limiting embodiment, the carbonate solvent additionally comprises at least one additional solvent. In another non-restrictive version, this additional solvent is selected from the group consisting of caprolactam, valerolactam, azetidinone, aza-2-cyclooctanone, aminododecanolactam, and combinations thereof. The volume ratio of organic carbonate to additional solvent ranges from about 90 to 10 independently to about 40 to 60; alternatively, in a volume ratio of from about 60 to 40 independently to about 40 to 60.

In a third non-limiting embodiment, the carbonate solvent additionally comprises at least one soluble metal salt, where the metal in the soluble metal salt is a transitional metal salt, but also including tin, magnesium, and/or aluminum. In a different, non-restrictive version, the metal in the metal salt is selected from the group consisting of iron, zinc, copper, tin, magnesium, aluminum, and combinations thereof. The metal salt types include, but are not necessarily limited to, chlorides, sulfates, carbonates, nitrates, oxides, hydroxides, carboxylates, acetates, acetylacetones, and combinations thereof. The amount of soluble metal salt in the carbonate solvent ranges from about 1 wt % independently to about 10 wt %; alternatively, from about 1.5 wt % independently to about 5 wt %. It is important that the salt be soluble so that the mixed solution is homogeneous.

In a fourth non-limiting embodiment, the carbonate solvent additionally comprises a mercaptan scavenger selected from the group consisting of heterocyclic amines. Non-limiting examples of suitable heterocyclic amines include oxazolidines, pyrrolidones (e.g., N-methyl-2-pyrrolidone or NMP), imidazolines, imidazole, glyoxals, triazines, quaternary amines, and combinations thereof. The amount of mercaptan scavenger in the carbonate solvent ranges from about 1 wt % independently to about 75 wt %; alternatively, from about 25 wt % independently to about 50 wt %. The optional components of these embodiments may be used together in various combinations.

Shown in FIG. 1 is a non-limiting, schematic illustration of one system 10 for recycling and reusing the carbonate solvent used in the present method in a non-restrictive version. A hydrocarbon stream or oil 12 containing a relatively high level of non-acidic sulfur compounds is introduced into mixing tank 14. Fresh carbonate solvent 16 is mixed with recycled carbonate solvent 18 to give mixed carbonate solvent feed 20 which is also introduced into mixing tank 14. Any conventional, suitable mixing tank 14 should be acceptable. The mixture of the oil 12 and mixed carbonate solvent feed 20 is fed via line 22 to separator 24 which separates out relatively low sulfur level oil 28 from the carbonate solvent 26 containing extracted non-acidic sulfur compounds, which is fed to distillation column 30 (solvent recovery). Recycled solvent distilled out from column 30 is withdrawn as stream 18, carbonate solvent containing concentrated sulfur compounds is sent out as bottoms 32, and solvent that is not otherwise recoverable is purged at 34.

Figure 2:
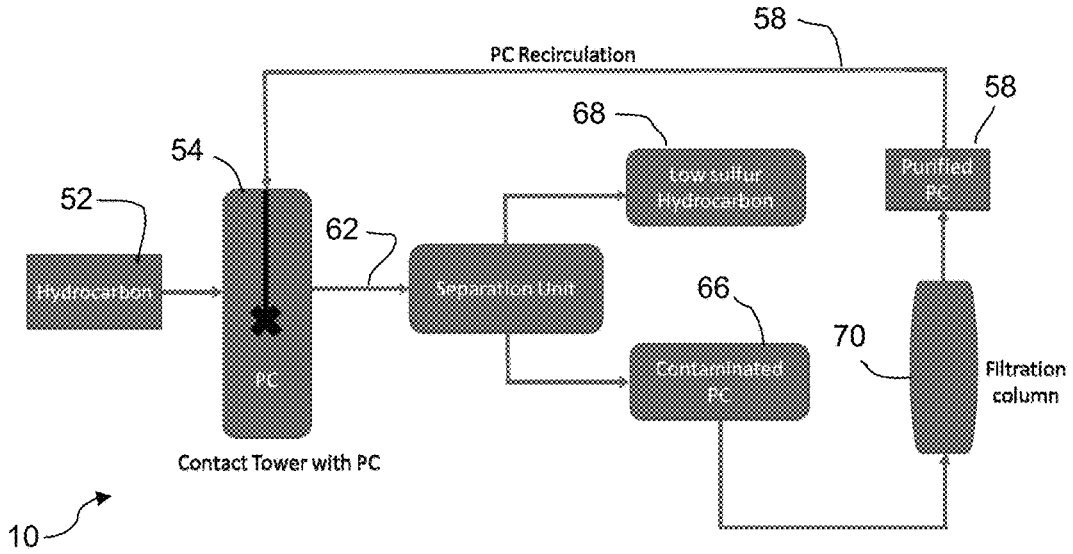
FIG. 2 is an alternative, non-limiting, schematic illustration of another system for recycling and reusing the carbonate solvent used in the present method.

Shown in FIG. 2 an alternative, non-limiting, schematic illustration of another system 50 for recycling and reusing the carbonate solvent used in the present method where a hydrocarbon stream or oil 52 containing a relatively high level of non-acidic sulfur compounds is introduced into contact tower 54 where the hydrocarbon stream 52 is mixed with propylene carbonate (PC), such as purified/recycled PC solvent 58. The mixture of the oil 52 and mixed carbonate solvent feed 20 is fed via line 62 to separation unit 64 which separates out relatively low sulfur level oil 68 from the carbonate solvent 66 containing extracted non-acidic sulfur compounds, which is fed to filtration column 70. Recycled solvent distilled out from column 70 is withdrawn as recycle stream 58.

To reduce the non-acidic sulfur compounds content of the hydrocarbon stream, a separation step can be required in some non-limiting embodiments. The separation can utilize solid absorbents like carbon, clay, and zeolites or alternatively the separation can utilize an extraction with caustic solutions or water. As used herein, caustic is sodium hydroxide (NaOH). The extraction solvent can optionally be part of the organic carbonate additive or it may be present in a contact tower, settling tank, water/caustic wash vessel, and the like. Small particle size absorbents (powdered carbon vs. carbon pellets) are advantageous in an absorbent in another non-limiting embodiment herein. Suitable powders may have a particle size of equal to or less than 0.075 mm, suitable granular sizes may have a particle size of 1.2-1.4 mm and suitable pellets may have a minimum size of 4 mm. The only necessary condition for this second extraction solvent is that it should have a pH of neutral or basic (i.e., equal to or greater than 7.0). Suitable clays include, but are not necessarily limited to, attapulgite, montmorillonite, bentonite, and the like. Because the carbonate solvent is denser than the hydrocarbon stream, the carbonate solvent comprising the absorbed non-acidic sulfur compounds can also be separated using known processes such as gravity settling, decantation, centrifugation, combinations thereof, and the like.

The high degree of selectivity toward non-acidic sulfur compounds is beneficial. In many cases customers want to remove the non-acidic sulfur compounds for safety reasons but mercaptans can be less of an issue. If the scavenger was not selective for non-acidic sulfur compounds, then dose rates would have to be higher, and the economics of the method would suffer.

There are other prior methods and processes for removing sulfur-containing compounds from hydrocarbon streams. Some require distillation columns, which are not necessary in the present method; that is, the present method has an absence of a distillation column, in one non-limiting embodiment. Some prior methods are limited to a certain range of hydrocarbons in the treated hydrocarbon stream, for instance C5-C10 hydrocarbons. The present method is not limited to absorbing non-acidic sulfur compounds from C5-C10 hydrocarbons. Another method requires the presence of both a dialdehyde and a triazine to scavenge acidic sulfur compounds such as $H_2S$ and mercaptans from media such as a hydrocarbon stream; the present method has an absence of a requirement of both a dialdehyde and a triazine, or alternatively a dialdehyde or a triazine, being present in the material contacting the hydrocarbon stream, in another non-restrictive version. In another non-limiting embodiment, the present method also has an absence of added caustics and/or reducing agents such as borohydrides. Some prior methods require the crude oil to be treated to be "topped" before treatment; "topping" in this context means removing the light ends by distillation at a temperature $T_{max}$, where 80° C.<$T_{max}$<260° C., in another non-limiting embodiment. And further, the present method has an absence of cocurrent extraction and/or counter-current extraction, in another non-restrictive version. The present method also has an absence of a stripping unit, as required by some prior methods, in another non-limiting embodiment.

In short, the method described herein provides a novel approach to use organic carbonate-based solvents to extract non-acidic sulfur from heavy fuels. The organic carbonates show excellent ability for selective extraction of non-acidic sulfur compounds from crude oil and heavy fuels.

The following examples are provided to illustrate the present method. The examples are not intended to limit the scope of the present method and they should not be so interpreted. Amounts are in weight parts or weight percentages unless otherwise indicated.

EXAMPLES

Sulfur Compound Extraction Using Propylene Carbonate

Propylene carbonate (PC) showed an enhanced ability towards sulfur extraction through liquid-liquid extraction in a first embodiment of the method herein. Where propylene carbonate forms an immiscible phase with the heavy crude it helps to remove the organosulfur compounds, but the methods described herein do not form such an immiscible phase. Also, the combination of PC with NMP and other possible solvents has been found to be effective. Results are reported below in Tables I and II. Non-acidic sulfur compounds that extracted included dimethyl sulfide, dimethyl disulfide, thiols, sulfides, thiophene and dibenzothiophene.

TABLE I

Extraction of Non-acidic Sulfur Compounds from Crude Oil using PC

| Ex. | Sample | Sulfur (ppm) | % Sulfur Reduction |
|---|---|---|---|
| 1 | Crude oil 1 | 5433 | — |
| 2 | Crude oil 1 + PC in a 40/60 vol. extraction ratio | 1180 | 78 |

TABLE II

Extraction of Non-acidic Sulfur Compounds from Crude Oil using PC

| Ex. | Sample | Sulfur (ppm) | % Sulfur Reduction |
|---|---|---|---|
| 3 | Crude oil 2 | 7896 | — |
| 4 | Crude oil 2 + PC in a 50/50 vol. extraction | 6012 | 24 |
| 5 | Crude oil 2 + PC-NMP (50/50 vol. mixture) in a 50/50 vol. extraction | 4331 | 45 |
| 6 | Crude oil 2 + PC-Caustic with NMP (75/25 vol. mixture) in a 50/50 vol. extraction | 7135 | 10 |

The method described herein using propylene carbonate can be performed with the optional inclusion of metal removal chemistry and separation by centrifugation, where extraction was done using a 50/50 volume slurry oil/PC ratio and centrifuged in a decanter process. Results are presented in Table Ill which show that including PC greatly increased the amount of non-acidic sulfur compounds removed (Ex. 9) compared to using only the metal removal chemistry alone (Ex. 8). The metal removal chemistry used in these Examples was phenyl formaldehyde resin with ethylene diamine mixture.

TABLE III

Extraction of Non-acidic Sulfur Compounds from Slurry Oil using PC and Metal Removal Chemistry

| Ex. | Sample | Sulfur (ppm) | % S Reduction |
|---|---|---|---|
| 7 | Slurry oil | 9085 | — |
| 8 | Slurry oil treated with metal removal chemistry only | 8998 | 1 |
| 9 | Slurry oil treated with metal removal chemistry loaded in PC (50/50) extraction | 6492 | 29 |

In examples of a third embodiment of the method, Table IV presents the use of an additional, small percentage of soluble metal salt compounds together with propylene carbonate which showed an improved ability for non-acidic sulfur compound removal through liquid-liquid extraction. The soluble metal salt compounds appear to act as a strong activation site for the removal of sulfur compounds. The amount of iron and copper metal salts used in Examples 11 and 13 respectively, was 1 wt %, whereas the amount of zinc salt used in Example 12 was 10 wt %. The metal salt form used in these Examples included chlorides, acetates, and actylacetonates.

TABLE IV

Extraction of Non-acidic Sulfur Compounds from Crude Oil using PC and Soluble Metal Salts

| Ex. | Sample | Sulfur (ppm) | % S Reduction |
|---|---|---|---|
| 10 | Crude oil 3 | 7112 | — |
| 11 | Crude oil 3 + Fe salt + PC | 6012 | 16 |
| 12 | Crude oil 3 + Zn salt + PC | 3396 | 52 |
| 13 | Crude oil 3 + Cu salt + PC | 5612 | 21 |

It was discovered that propylene carbonate in combination with another solvent (NMP) and a soluble zinc salt gave a synergist extraction of non-acidic sulfur compounds from crude oil 3. Here, synergism is shown, defined as where the result of Ex. 16 (53% sulfur extraction) using PC, NMP, and a Zn salt is more than the result from a 50/50 mixture of NMP alone of Ex. 14 (15%) added to the result from a 50/50 mixture of NMP alone including a Zn salt (27%). That is: 53%>15%+27%. The amount of soluble Zn salt used in Examples 15 and 16 ranged from about 0.1 to about 10 wt %. In Example 16, the ratio of PC/NMP was 1/1. The total ratio of solvent (NMP alone or NMP+PC to crude oil was 50/50. See the results presented in Table V.

TABLE V

Synergistic Extraction of Non-acidic Sulfur Compounds from Crude Oil using PC, NMP and Metal Removal Chemistry

| Ex. | Sample | Sulfur (ppm) | % S Reduction |
|---|---|---|---|
| 10 | Crude oil 3 | 7112 | — |
| 14 | Crude oil 3 + NMP 50/50 extraction | 6079 | 15 |
| 15 | Crude oil 3 + Zn + NMP 50/50 extraction | 5223 | 27 |
| 16 | Crude oil 3 + PC + Zn + NMP 50/50 extraction | 3348 | 53 |

An example of a fourth embodiment of the method described herein includes the addition of a mercaptan scavenger (quaternary ammonium hydroxide or "quat") together with propylene carbonate showed an enhanced ability for sulfur removal through liquid-liquid extraction in Example 17. The mercaptan scavenger appears to trap the non-acidic sulfur compounds and together with PC facilitates removal of the sulfur compounds as shown in Table VI.

TABLE VI

Extraction of Non-acidic Sulfur Compounds from Crude Oil using PC and Mercaptan Scavenger Chemistry

| Ex. | Sample | Sulfur (ppm) | % S Reduction |
|---|---|---|---|
| 3 | Crude oil 2 | 7896 | — |
| 17 | Crude oil 2 + Quat (1000 ppm) in PC 50/50 extraction | 6314 | 20 |

Figure 3:
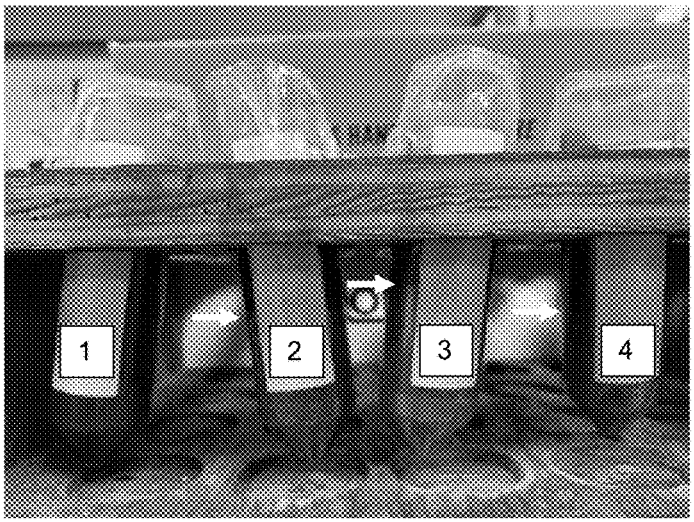
FIG. 3 is a photograph of four samples showing good separation achieved with a carbonate solvent comprising propylene carbonate (PC) achieved by the present method where Vial 1 used only N-methyl-2-pyrrolidone (NMP), Vial 2 used a mixture of PC and NMP, Vial 3 used a mixture of PC, NMP, and caustic, and Vial 4 used PC alone.

FIG. 3 is a photograph of four samples showing good separation achieved with a carbonate solvent comprising propylene carbonate achieved by the present method where Vial 1 used only N-methyl-2-pyrrolidone (NMP), Vial 2 used a mixture of PC and NMP, Vial 3 used a mixture of PC, NMP, and caustic, and Vial 4 used PC alone.

Figure 4:
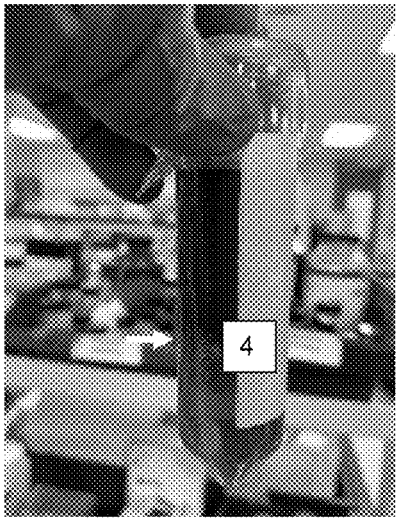
FIG. 4 is a closer photograph of the sample showing good separation achieved with a carbonate solvent comprising propylene carbonate achieved by the present method from Example 4 of FIG. 4 using PC alone.

For clarity, the boundary between the oil layer (top) and the organic carbonate (bottom) is shown with a white arrow. FIG. 4 is a closer photograph of a sample showing good separation achieved with a carbonate solvent comprising propylene carbonate achieved by the present method from Vial 4.

A second embodiment of the method described herein is illustrated in the results presented in Table VII for Examples 18-23. In these Examples, 20 ml of pentane was dosed with 80.25 ppm of dimethyl sulfide (DMS). Each sample was extracted with 20 ml of the chemistry indicated and the sulfur contents measured. In Ex. 18, only caustic was used, which gave very poor separation. In Ex. 19 only propylene carbonate was used. In Ex. 21, only valerolactone was used, whereas in Examples 20, 22, and 23, PC was used together with the indicated additional solvent. In these Examples the proportion of PC/additional solvent was 50/50 by volume. As noted, multiple cycles were used in Examples 19-21, where the total amount of sulfur removed increased with each cycle.

TABLE VII

Extraction of DMS from Pentane using PC and Additional Solvent

| Ex. | Additive | Untreated Pentane S content (ppm) | Untreated Pentane (ppm) $1^{st}$ Cycle | Untreated Pentane (ppm) $2^{nd}$ Cycle | Untreated Pentane (ppm) $3^{rd}$ Cycle | Untreated Pentane (ppm) $4^{th}$ Cycle | Untreated Pentane (ppm) $5^{th}$ Cycle | Phase Separation |
|---|---|---|---|---|---|---|---|---|
| 18 | Caustic | 80.25 | 79.5 | 79.3 | 79.3 | 79.2 | 79.2 | Good |
| 19 | PC | 80.25 | 39.13 | 20.15 | 11.2 | 4.48 | 2.08 | Good |
| 20 | PC-NMP | 80.25 | 26.51 | 10.5 | 4.47 | | | Good |
| 21 | Valerolactone | 166.79 | 48.78 | 13.55 | | | | Good |
| 22 | PC-Valerolactone | 166.79 | 69.59 | | | | | Good |
| 23 | Caprolactam-PC | 166.79 | 83.91 | | | | | Good |

Presented in Tables VIII, IX, and X are the results of extracting a non-acidic sulfur compound from pentane using various solvents. In these Examples, 20 ml of pentane was dosed with 80.25 ppm of thiophene. Each sample was extracted with 20 ml of the chemistry indicated and the sulfur contents measured. In Ex. 24, only caustic was used, which gave very poor separation. In Ex. 25 only propylene carbonate commercially sourced was used. In Ex. 21, only PC from Baker Hughes was used, whereas in Example 27, PC was used together with NMP, which gave the best results. In these Examples 25 and 27, the proportion of PC/additional solvent was 50/50 by volume. As noted, multiple cycles were used in Examples 24-27, where the amount of sulfur removed increased with each cycle.

Figure 5:
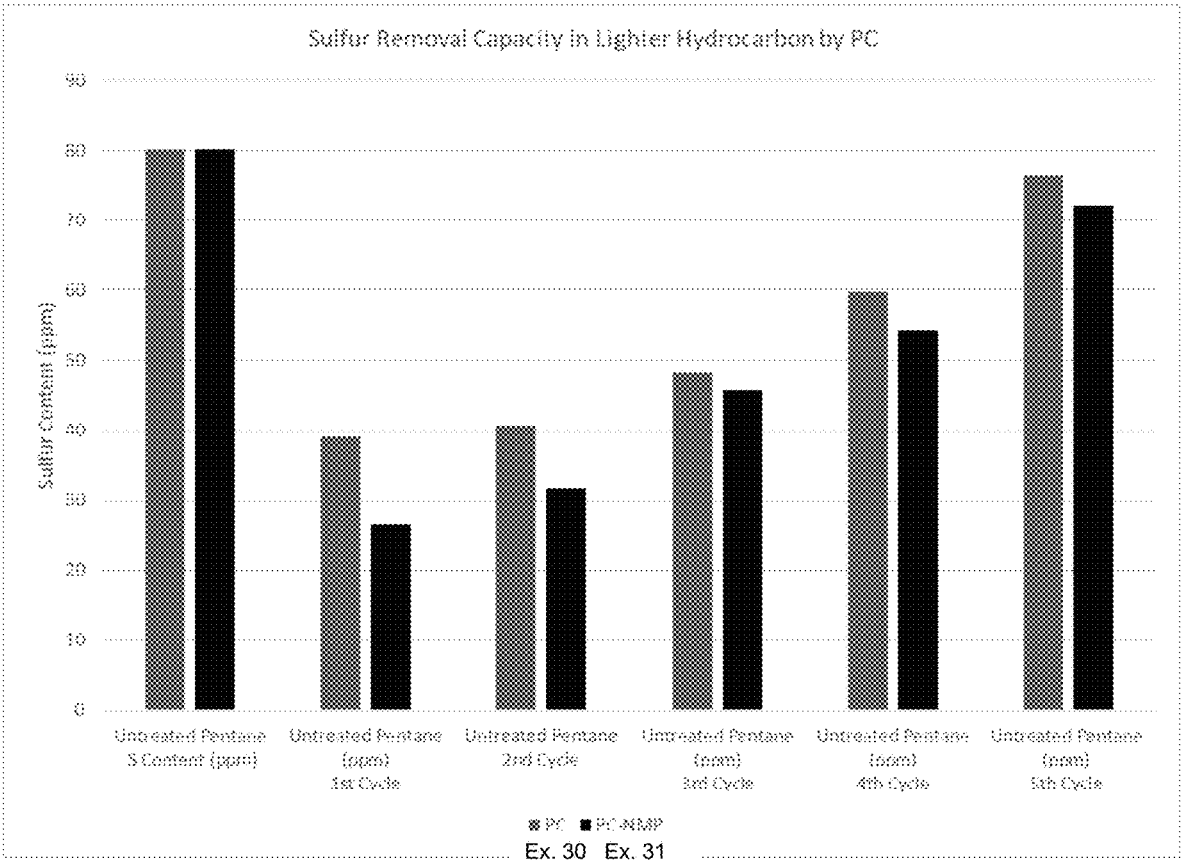
FIG. 5 is a bar chart of sulfur removal capacity in lighter hydrocarbon using propylene carbonate (PC) as the only active component and PC together with N-methyl-2-pyrrolidone (NMP) from Examples 30 and 31.

In Examples 28-31, 20 ml of pentane was dosed with 80.25 ppm of DMS, which was extracted with 20 ml of the indicated chemistry and the sulfur contents were measured. Fresh chemistry was added and the amount of sulfur measured. For the addition of fresh chemistry, the sulfur amount is supposed to decrease, while with fresh hydrocarbon, the sulfur content would decrease initially, and then increase to saturation of the chemistry with the sulfur species FIG. 5 is a bar chart of the results of Examples 30 and 31.

Examples 32, 33, and 34 are similar to Examples 25, 26, and 27, respectively, except that fresh chemistry was added at each stage and the amount of sulfur measured. In this case, there was fresh hydrocarbon, and as such the sulfur content while initially decreasing would increase subsequently with the saturation of the chemistry.

TABLE VIII

Extraction of Thiophene from Pentane using Caustic Incumbent, PC, and PC-NMP Mixture

| Ex. | Additive | Untreated Pentane S content (ppm) | Untreated Pentane (ppm) 1st Cycle | Untreated Pentane (ppm) 2nd Cycle | Untreated Pentane (ppm) 3rd Cycle | Untreated Pentane (ppm) 4th Cycle | Untreated Pentane (ppm) 5th Cycle | Phase Separation |
|---|---|---|---|---|---|---|---|---|
| 24 | Caustic Incumbent | 83.3 | 82.5 | 83.5 | 82.5 | 82.5 | 82.5 | Good |
| 25 | PC-Commercial | 83.3 | 42.07 | 24.5 | 9.52 | 3.56 | 1.47 | Good |
| 26 | PC-Baker Hughes | 83.3 | 39.7 | 19.6 | 8.76 | 4.45 | 1.57 | Good |
| 27 | PC-NMP | 83.3 | 27.47 | 8.03 | 1.89 | | | Good |

TABLE IX

Extraction of DMS from Pentane using Caustic Incumbent, PC, and PC-NMP Mixture

| Ex. | Additive | Untreated Pentane S content (ppm) | Untreated Pentane (ppm) 1st Cycle | Untreated Pentane (ppm) 2nd Cycle | Untreated Pentane (ppm) 3rd Cycle | Untreated Pentane (ppm) 4th Cycle | Untreated Pentane (ppm) 5th Cycle | Phase Separation |
|---|---|---|---|---|---|---|---|---|
| 28 | Caustic incumbent | 80.25 | 79.5 | 79.3 | 79.3 | 79.2 | 79.2 | Good |
| 29 | PC-Commercial | 80.25 | 39.23 | 38.33 | 49.79 | 57.6 | 74.6 | Good |
| 30 | PC-Baker Hughes | 80.25 | 39.13 | 40.7 | 48.23 | 59.8 | 76.4 | Good |
| 31 | PC-NMP | 80.25 | 26.51 | 31.72 | 45.75 | 54.18 | 72.1 | Good |

TABLE X

Extraction of Thiophene from Pentane using Caustic Incumbent, PC, and PC-NMP Mixture

| Ex. | Additive | Untreated Pentane S content (ppm) | Untreated Pentane (ppm) 1st Cycle | Untreated Pentane (ppm) 2nd Cycle | Untreated Pentane (ppm) 3rd Cycle | Untreated Pentane (ppm) 4th Cycle | Phase Separation |
|---|---|---|---|---|---|---|---|
| 24 | Caustic Incumbent | 83.3 | 82.5 | 83.5 | 82.5 | 82.5 | Good |
| 32 | PC-Commercial | 83.3 | 42.07 | 53.77 | 70.08 | 80.5 | Good |
| 33 | PC-Baker Hughes | 83.3 | 42.07 | 53.77 | 70.08 | 80.5 | Good |
| 34 | PC-NMP | 83.3 | 27.47 | 43.7 | 56.42 | 75.3 | Good |

In the foregoing specification, the invention has been described with reference to specific embodiments thereof, and has been demonstrated as effective in providing configurations, methods, and compositions for removing non-acidic sulfur compounds from streams or volumes containing hydrocarbons, such crude oil and refinery distillate streams containing them. However, it will be evident that various modifications and changes can be made thereto without departing from the broader scope of the invention as set forth in the appended claims. Accordingly, the specification is to be regarded in an illustrative rather than a restrictive sense. For example, the type of hydrocarbon streams, the types, amounts and ratios of organic carbonates, optional components such as additional solvents, soluble metal salts, and/or mercaptan scavengers, treatment procedures, solvents, co-solvents, extraction parameters, and other components and/or conditions falling within the claimed parameters, but not specifically identified or tried in a particular method, are expected to be within the scope of this invention. Further, it is expected that the method may change somewhat from one application to another and still accomplish the stated purposes and goals of the methods described herein.

The present invention may suitably comprise, consist, or consist essentially of the elements disclosed and may be practiced in the absence of an element not disclosed. For instance, there may be provided a method for selectively extracting non-acidic sulfur compounds from a hydrocarbon stream containing the non-acidic sulfur compounds, the method comprising, consisting essentially of, or consisting of contacting the hydrocarbon stream with a carbonate solvent, where the carbonate solvent comprises, consists essentially of, or consists of at least one organic carbonate and in an amount of carbonate solvent that is effective to selectively extract at least a portion of the non-acidic sulfur compounds from the hydrocarbon, and selectively absorbing and extracting at least a portion of the non-acidic sulfur compounds from the hydrocarbon stream into the carbonate solvent.

In another non-limiting instance, there may be provided a treated stream comprising, consisting essentially of, or consisting of, hydrocarbons, at least one non-acidic sulfur compound, and a carbonate solvent comprising, consisting essentially of, or consisting of at least one organic carbonate, where the at least one organic carbonate is present in an amount effective to extract at least a portion of the non-acidic sulfur compound from the treated stream into the carbonate solvent.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature, or method act indicates that such is contemplated for use in implementation of an embodiment of the disclosure and such term is used in preference to the more restrictive term "is" so as to avoid any implication that other, compatible materials, structures, features, and methods usable in combination therewith should or must be, excluded.

As used herein, the singular forms "a," "an," and "the" are intended to include the plural forms as well, unless the context clearly indicates otherwise.

As used herein, the term "and/or" includes any and all combinations of one or more of the associated listed items.

As used herein, relational terms, such as "first," "second," "top," "bottom," "upper," "lower," "over," "under," etc., are used for clarity and convenience in understanding the disclosure and do not connote or depend on any specific preference, orientation, or order, except where the context clearly indicates otherwise.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

What is claimed is:

1. A method for selectively extracting non-acidic sulfur compounds from a hydrocarbon stream containing the non-acidic sulfur compounds, the method comprising:

contacting the hydrocarbon stream with a carbonate solvent in an amount of carbonate solvent that is effective to selectively solvate at least a portion of the non-acidic sulfur compounds from the hydrocarbon stream without chemically reacting with the sulfur non-acidic sulfur compounds, where the carbonate solvent comprises:

at least one organic carbonate; and at least one soluble metal salt selected from the group consisting of sulfates, nitrates, acetates, and acetylacetonates;

selectively absorbing and extracting at least a portion of the non-acidic sulfur compounds from the hydrocarbon stream into the carbonate solvent; and separating the at least a portion of the non-acidic sulfur compounds from the carbonate solvent through filtration of the carbonate solvent to obtain a purified carbonate solvent.

2. The method of claim 1 where the at least one organic carbonate is selected from the group consisting of ethylene carbonate, propylene carbonate, glycerol carbonate, styrene carbonate, and combinations thereof.

3. The method of claim 1 where the hydrocarbon stream is selected from the group consisting of crude oil, heavy fuel oil, middle distillates, diesel fuel, gas oil, slurry oil, and mixtures thereof.

4. The method of claim 1 where the effective amount of carbonate solvent to hydrocarbon stream ranges from a volume ratio of about 1 to 99 to about 50 to 50.

5. The method of claim 1 where the carbonate solvent additionally comprises at least one additional solvent selected from the group consisting of caprolactam, valerolactam, azetidinone, aza-2-cyclooctanone, aminododecanolactam, and combinations thereof.

6. The method of claim 5 where the volume ratio of organic carbonate to additional solvent ranges from about 90 to 10 to about 40 to 60.

7. The method of claim 1, where the metal in the soluble metal salt is selected from the group consisting of iron, zinc, copper, tin, magnesium, aluminum, and combinations thereof.

8. The method of claim 7 where the amount of soluble metal salt in the carbonate solvent ranges from about 1 wt % to about 10 wt %.

9. The method of claim 1 where the carbonate solvent additionally comprises a mercaptan scavenger selected from the group consisting of heterocyclic amines.

10. The method of claim 9 where the amount of mercaptan scavenger in the carbonate solvent ranges from about 1 wt % to about 75 wt %.

11. The method of claim 1 where the non-acidic sulfur compounds are selected from the group consisting of thiols, sulfides, disulfides, thiolanes, thiophenes, benzothiophenes, dibenzothiophenes, benzonaphthothiophenes, and combinations thereof.

12. The method of claim 1 further comprising the step of recycling the purified carbonate solvent to treat a subsequent volume of hydrocarbon stream having non-acidic sulfur compounds.

13. A treated stream comprising:

hydrocarbons;

at least one non-acidic sulfur compound; and a carbonate solvent comprising:

at least one organic carbonate, where the organic carbonate is propylene carbonate;

at least one soluble metal salt, where the metal in the soluble metal salt is tin; and at least one oxazolidine;

where the at least one organic carbonate is present in an amount effective to solvate at least a portion of the non-acidic sulfur compound from the treated stream into the carbonate solvent without reacting with the non-acidic sulfur compound.

14. The treated stream of claim 13 where the hydrocarbon stream is selected from the group consisting of crude oil, heavy fuel oil, middle distillates, diesel fuel, gas oil, slurry oil, and mixtures thereof.

15. The treated stream of claim 13 where the effective amount of carbonate solvent to hydrocarbon stream ranges from a volume ratio of about 1 to 99 to about 50 to 50.

16. The treated stream of claim 13 where the carbonate solvent additionally comprises at least one additional solvent selected from the group consisting of caprolactam, valerolactam, azetidinone, aza-2-cyclooctanone, aminododecanolactam, and combinations thereof.

17. A method for selectively extracting non-acidic sulfur compounds from a hydrocarbon stream, the method comprising:

contacting the hydrocarbon stream with a carbonate solvent comprising at least one organic carbonate and at least one soluble metal salt selected from the group consisting of sulfates, nitrates, acetates, and acetylacetonates;

separating the hydrocarbon stream from the carbonate solvent, where the carbonate solvent contains at least a portion of the non-acidic sulfur compounds from the hydrocarbon stream;

separating the at least a portion of the non-acidic sulfur compounds from the carbonate solvent through filtration of the carbonate solvent to obtain a purified carbonate solvent; and recycling the purified carbonate solvent to treat a subsequent volume of hydrocarbon stream having non-acidic sulfur compounds.

18. The method of claim 17 where the at least one organic carbonate is selected from the group consisting of ethylene carbonate, propylene carbonate, glycerol carbonate, styrene carbonate, and combinations thereof.

19. The method of claim 17 where the step of recycling the purified carbonate solvent further comprises the steps of:

mixing the purified carbonate solvent with a fresh carbonate solvent to obtain a mixed carbonate solvent feed; and introducing the mixed carbonate solvent feed into a mixing tank with the subsequent volume of hydrocarbon stream.

20. The method of claim 17, wherein the metal in the soluble metal salt is tin.

* * * * *